US007373293B2

(12) United States Patent
Chang et al.

(10) Patent No.: US 7,373,293 B2
(45) Date of Patent: May 13, 2008

(54) QUANTIZATION NOISE SHAPING METHOD AND APPARATUS

(75) Inventors: Tae-gyu Chang, Seoul (KR); Heung-yeop Jang, Suwon-si (KR)

(73) Assignee: Samsung Electronics Co., Ltd., Suwon (KR)

( * ) Notice: Subject to any disclaimer, the term of this patent is extended or adjusted under 35 U.S.C. 154(b) by 806 days.

(21) Appl. No.: 10/720,762

(22) Filed: Nov. 25, 2003

(65) Prior Publication Data

US 2004/0170290 A1 Sep. 2, 2004

(30) Foreign Application Priority Data

Jan. 15, 2003 (KR) ..... 10-2003-0002718

(51) Int. Cl.
*G10L 19/02* (2006.01)
*G10L 21/00* (2006.01)

(52) U.S. Cl. ..... 704/200.1; 704/226; 704/229; 704/230

(58) Field of Classification Search ..... 704/200, 704/200.1, 226, 230, 229
See application file for complete search history.

(56) References Cited

U.S. PATENT DOCUMENTS 5,757,938 A * 5/1998 Akagiri et al. ..... 381/98
5,930,750 A * 7/1999 Tsutsui ..... 704/229
6,138,093 A * 10/2000 Ekudden et al. ..... 704/228
6,138,101 A * 10/2000 Fujii ..... 704/500
6,456,963 B1 * 9/2002 Araki ..... 704/200.1
6,466,912 B1 * 10/2002 Johnston ..... 704/500
6,473,731 B2 * 10/2002 Hinderks ..... 704/200.1
6,499,010 B1 * 12/2002 Faller ..... 704/229
6,542,865 B1 * 4/2003 Nagao et al. ..... 704/229
6,604,069 B1 * 8/2003 Tsutsui ..... 704/200.1
6,697,775 B2 * 2/2004 Kawahara ..... 704/229
6,725,192 B1 * 4/2004 Araki ..... 704/230
6,915,255 B2 * 7/2005 Watanabe ..... 704/200.1
6,950,794 B1 * 9/2005 Subramaniam et al. .. 704/200.1
7,080,007 B2 * 7/2006 Son et al. ..... 704/210
2002/0173948 A1 * 11/2002 Hilpert et al. ..... 704/200.1
2003/0182104 A1 * 9/2003 Muesch ..... 704/200.1
2004/0024588 A1 * 2/2004 Watson et al. ..... 704/200.1

OTHER PUBLICATIONS

Najafzadeh, Hossein, "Perceptual Bit Allocation for Low Rate Coding of Narrowband Audio," Jun. 2000, Procs. IEEE International Conference on Acoustics, Speech, and Signal Processing, pp. 893-896.*

* cited by examiner

*Primary Examiner*—Tālivaldis Ivars Šmits
*Assistant Examiner*—Douglas C Godbold
(74) *Attorney, Agent, or Firm*—Sughrue Mion, PLLC

(57) ABSTRACT

A method and apparatus for shaping quantization noise generated when compressing audio data at a low bit rate is disclosed. A predetermined quantization noise threshold allowed during quantization of sampled audio data and quantization noise energy information of a quantized MDCT coefficient are received in all frequency bands of an audio frequency. The quantization noise energy of the quantized MDCT coefficient is attenuated in a predetermined number of frequency bands in which a difference between the predetermined quantization noise threshold and the quantization noise energy of the quantized MDCT coefficient is large.

3 Claims, 7 Drawing Sheets

QUANTIZATION NOISE SHAPING METHOD AND APPARATUS

BACKGROUND OF THE INVENTION

This application claims the priority of Korean Patent Application No. 2003-2718, filed on Jan. 15, 2003, in the Korean Intellectual Property Office, the disclosure of which is incorporated herein in its entirety by reference.

1. Field of the Invention

The present invention relates to compression of audio data, and more particularly, to a method and apparatus for shaping quantization noise generated when compressing audio data at a low bit rate.

2. Description of the Related Art

Compression of audio data is achieved by performing sampling, quantizing, encoding, and so forth. Quantization refers to expressing sampled signal values as stepped integers to represent the sampled values as predetermined representative values. Such a quantization process generates quantization noise. The quantization noise is an error component between an original signal and a quantized signal and is attenuated with an increase in a number of bits used for the quantization process. In quantization according to the Moving Picture Experts Group (MPEG), which are standards for coded representation of moving pictures and digital audio, a factor generated by a Discrete Cosine Transform (DCT) or a Modified DCT (MDCT) is divided by a predetermined value to express the factor as a low factor value so as to reduce an encoding amount.

Audio data should be compressed in consideration of the properties of the human auditory system. In general, one sound cannot be heard when a much louder sound is present. For example, if a person in an office speaks loudly, the others in the office can easily perceive who is speaking. However, if an airplane passes over the office building, the listeners cannot hear at all what the speaker is saying. In addition, after the airplane passed over the building, the listeners still cannot hear what the speaker is saying due to the lingering sound of the airplane. This is called a masking effect.

FIG. 1 illustrates the masking effect. Referring to FIG. 1, let us assume that an audio frequency contains a masking curve 130 indicating a sound energy level at which the average human can hear a sound. Since an audio signal A 110 has a sound energy level above the masking curve 130, the audio signal A 110 is audible to the average human. In contrast, since an audio signal B 120 has a sound energy level below the masking curve 130, the audio signal B 120 is inaudible to the average human.

Psychoacoustic model quantization refers to the quanitzation of only audio data with a sound energy level above a masking threshold by sectioning an audio frequency into frequency bands at predetermined intervals. The psychoacoustic model quantization is used in compression standards such as MPEG. However, in a case where audio data is compressed at a low bit rate below 64 Kbps, a number of bits used for quantization is limited. Thus, a general compression technique according to MPEG standards is not suitable for an effective compression of an audio signal.

FIGS. 2A and 2B show a quantization noise spectrum with respect to a frequency, the spectrum being generated after performing quantization.

In a psychoacoustic model, an audio signal is received, and then a Fast Fourier Transform (FFT) is performed to calculate and output a quantization threshold 210 in each frequency band. The quantization threshold 210 may be calculated so that the average human cannot discern between an original signal and a quantized signal. A quantization threshold in actual quantization may appear as reference numeral 210 or 240. If the quantization threshold 210 is obtained in the actual quantization, quantization noise may fall within the quantization threshold 210 according to the psychoacoustic model, which does not affect sound quality. If the quantization threshold 240 is obtained in the actual quantization, sound quality degrades. Thus, quantization noise has to be shaped so as to fall within the quantization threshold 210. However, since a low bit rate audio signal is expressed and quantized with a limited number of bits, quantization noise cannot always be shaped within a quantization threshold.

Accordingly, a conventional quantization algorithm used for the compression of an audio signal uses a simple way to confine a number of times quantization noise is shaped so that the shaping of the quantization noise ends when quantization noise cannot be below a quantization threshold calculated in the psychoacoustic model. The confinement may allow the quantization noise to have a predetermined shape, which causes the quantization noise to exceed the quantization threshold in a predetermined number of frequency bands. As a result, sound quality deteriorates.

SUMMARY OF THE INVENTION

The present invention provides a quantization noise shaping method and apparatus, by which the distortion of audio data can be reduced by shaping quantization noise generated during quantization of low bit rate audio data so that a quantization noise curve is similar to a quantization threshold curve calculated in a psychoacoustic model even though the quantization noise is above the quantization threshold in all frequency bands.

According to an aspect of the present invention, there is provided a method of shaping quantization noise. A predetermined quantization noise threshold allowed during quantization of sampled audio data and quantization noise energy information of a quantized MDCT coefficient are received in all frequency bands of an audio frequency. The quantization noise energy of the quantized MDCT coefficient is attenuated in a predetermined number of frequency bands in which a difference between the predetermined quantization noise threshold and the quantization noise energy of the quantized MDCT coefficient is large.

According to another aspect of the present invention, there is provided a method of shaping quantization noise. During compression of an audio signal at a predetermined bit rate, a determination is made as to whether quantization noise in all frequency bands falls below a threshold noise level calculated in a psychoacoustic model. If the quantization noise does not fall below the threshold noise level, quantization noise is shaped in each of the frequency bands to be equal to the threshold noise level, with an offset error.

According to still another aspect of the present invention, there is provided a method of shaping quantization noise. Total quantization noise of a quantized MDCT coefficient and a sum of quantization noise thresholds calculated in a psychoacoustic model are calculated. The total quantization noise of the quantized MDCT coefficient is compared with the sum of the quantization noise thresholds. If the total quantization noise of the quantized MDCT coefficient is less than the sum of the quantization noise thresholds, quantization noise is attenuated in every frequency band, while if the total quantization noise of the quantized MDCT coefficient is greater than the sum of the quantization noise thresholds, quantization noise is attenuated in selected frequency bands.

According to yet another aspect of the present invention, there is provided an apparatus for adjusting a quantization noise distribution. The apparatus includes a quantization noise calculator that calculates total quantization noise of a quantized MDCT coefficient and a sum of quantization noise thresholds calculated in a psychoacoustic model, a noise attenuation algorithm selector that compares the total quantization noise of the quantized MDCT coefficient with the sum of the quantization noise thresholds to determine whether a quantization noise attenuation is performed in every frequency bands or in selected frequency bands, a quantization noise attenuator that attenuates quantization noise in every frequency band, and a band selective quantization noise attenuator that attenuates quantization noise in selected frequency bands.

According to yet another aspect of the present invention, there is provided a computer-readable recording medium on which a program for executing the method of the present invention in a computer is recorded.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
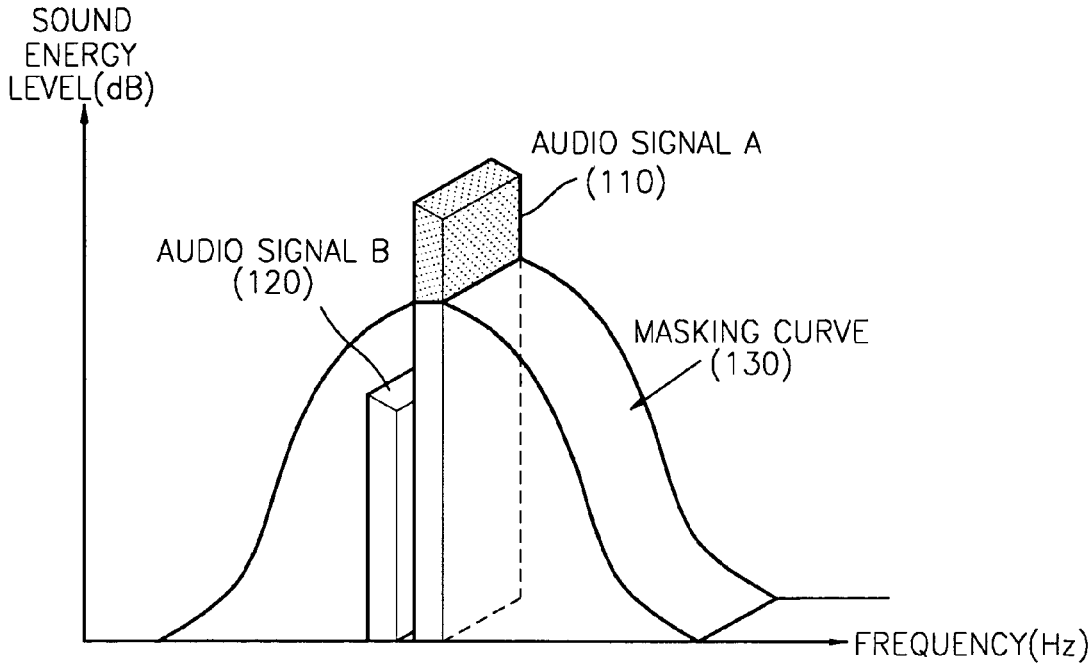
FIG. 1 (PRIOR ART)
FIG. 1 illustrates a masking effect.
Figure 2A:
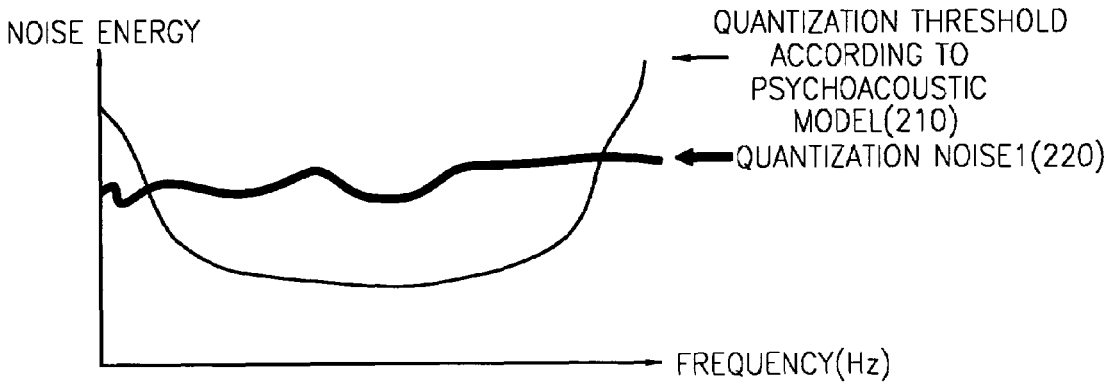
FIG. 2A (PRIOR ART)
FIGS. 2A and 2B show a quantization noise spectrum with respect to a frequency, the spectrum being generated after performing quantization.
Figure 2B:
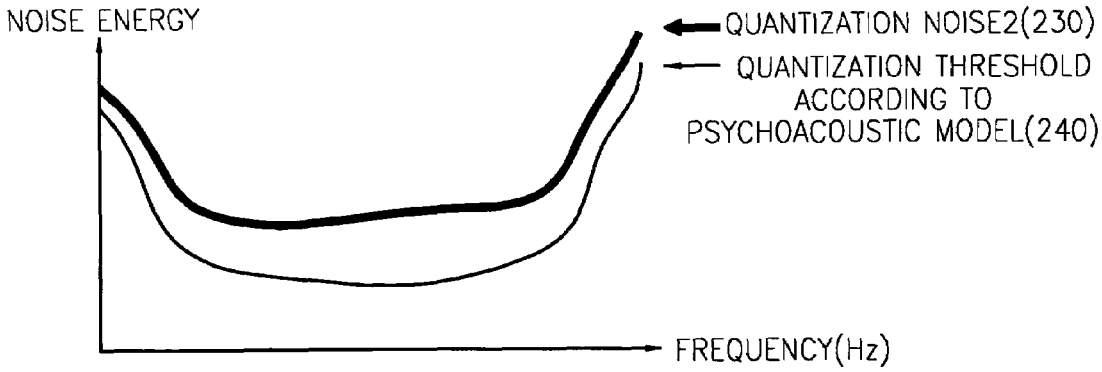
FIG. 2B (PRIOR ART)
Figure 3:
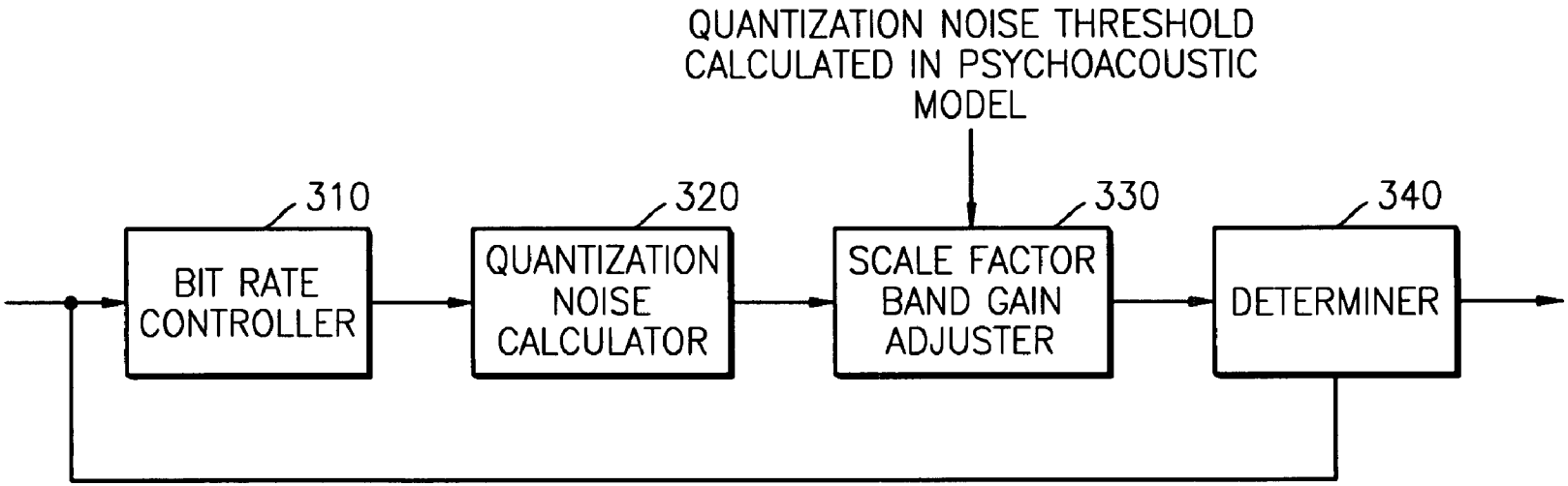
FIG. 3 is a block diagram of a quantization noise shaping apparatus.

FIG. 3 is a block diagram of a quantization noise shaping apparatus. A quantizer for an MPEG audio encoder includes a bit rate controller 310 which controls a bit rate, a quantization noise calculator 320 which calculates quantization noise energy, a scale factor band gain adjuster 330 which compares the quantization noise energy received from the quantization noise calculator 320 with a quantization noise threshold received from a psychoacoustic model and adjusts a scale factor band gain given to each frequency band to shape a quantization noise curve in each frequency band, and a determiner 340 which transmits a command to reset a number of bits to the bit rate controller 310 and determines whether to end a quantization process under a predetermined condition. The operations of the above components are described in detail in the MPEG standards (ISO 14496-3 Annex B).

The bit rate controller 310 receives an audio frame, quantizes an MDCT coefficient of the received audio frame, Huffman-codes the quantization result, and calculates a number of bits used during the Huffman-coding. In other words, the bit rate controller 310 calculates a number of bits corresponding to a bit rate determined for coding of an audio signal and adjusts the number of bits until a number of bits smaller than the calculated number of bits can be used for coding, by adjusting a common gain.

When a quantized MDCT coefficient is denoted as $x_{quant}$, a received MDCT coefficient is denoted as mdct_line, and a scale factor is denoted as sf, the quantized MDCT coefficient $X_{quant}$ is calculated as in Equation 1:

$$x_{quant} = \text{mdct_line}^{\frac{3}{4}} 2^{\frac{-3}{16}(sf-100)} \tag{1}$$

The scale factor sf is calculated as in Equation 2:

$$sf = \text{common}_{13}\ \text{gain} - sfb_\text{gain}(sfb) \tag{2}$$

wherein common_gain is the common gain that is used to satisfy a given number of bits in the audio frame and is determined by an internal loop that adjusts a number of bits to be used to a predetermined bit rate, and sfb_gain is the scale factor band gain indicating a degree to which a scale factor is adjusted to shape the quantization noise and is determined by an external loop that selectively adjusts the scale factor band gain sfb_gain in each frequency band. Consequently, sfb_gain is expressed as a function of the sfb. As can be seen in Equations 1 and 2, the common gain common_gain should be low and the scale factor band gain sfb_gain should be large in order that an error between the quantization MDCT coefficient $x_{quant}$ and the received MDCT coefficient mdct_line is low.

The quantization noise calculator 320 calculates quantization noise in each frequency band using the error between the quantization MDCT coefficient $x_{quant}$ and the received MDCT coefficient mdct_line.

The scale factor band gain adjuster 330 compares the quantization noise received from the quantization noise calculator 320 with the quantization noise threshold received from psychoacoustic model to adjust a quantization noise level in each frequency band. The adjustment of the quantization noise level in each frequency band is achieved by adjusting the scale factor band gain.

The determiner 340 adjusts the scale factor to shape the quantization noise and then makes a determination whether to end the quantization process by determining whether the adjusted scale factor band gain has been amplified to a predetermined maximum value, whether differences among the scale factor band gains adjusted in frequency bands are greater than a predetermined reference value or whether quantization noise in every frequency band is lower than the quantization noise threshold calculated in the psychoacuostic model.

In a conventional quantization noise shaping method, a common gain commonly applied to every frequency band is adjusted to perform an internal loop that adjusts a number of bits to be used to a predetermined bit rate and an external loop that adjusts a scale factor band gain used for shaping of the level of quantization noise in each frequency band. In the external loop, a number of bits allocated to each frequency bandwidth are summed, a common gain is increased to reduce a used number of bits if the summed value is greater than a predetermined threshold, to which the scale factor band gain adjusted in each frequency band is encoded, to be less than a predetermined threshold, and the scale factor band gain is increased in each frequency band to a predetermined value so that the scale factor band gain stays below a predetermined threshold in each frequency band. The external loop is repeated until the quantization noise in every frequency band falls within the quantization noise threshold.

Figure 4:
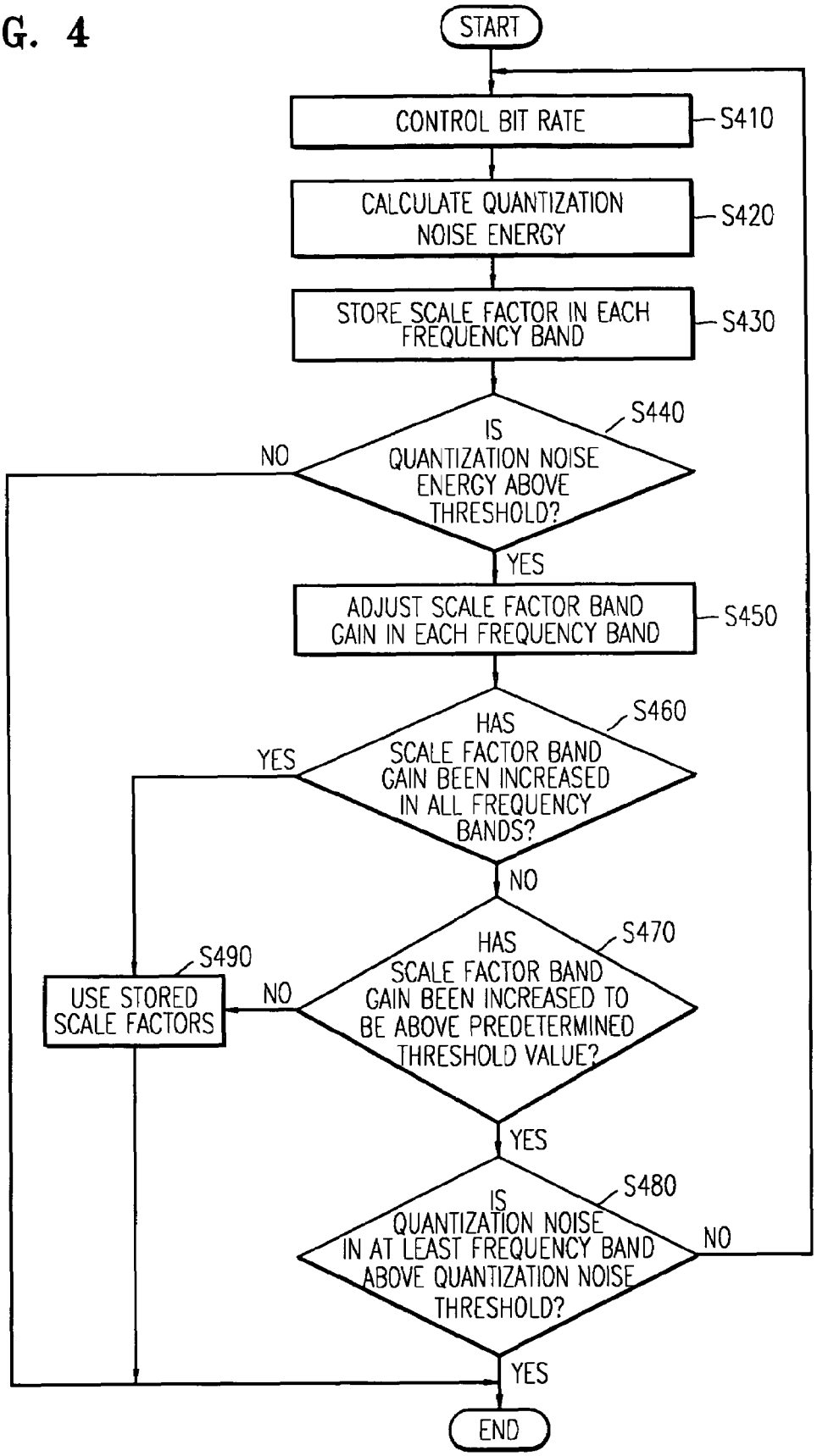
FIG. 4 is a flowchart of a method of shaping quantization noise.

FIG. 4 is a flowchart of a method of shaping quantization noise. The method includes: calculating a number of bits corresponding to a predetermined bit rate at which an audio signal is to be coded and adjusting a common gain until a number of bits smaller than the calculated number of bits is used for the coding of the audio signal so as to adjust the number of bits used for the coding.

In step S410, a bit rate is controlled. In other words, an audio frame is received and then an MDCT coefficient of the audio frame is quantized. Next, the quantized MDCT coefficient is Huffman-coded, and then a number of bits used for the Huffman-coding is calculated. In other words, a number of bits corresponding to a predetermined bit rate at which an audio signal is to be coded is calculated, and then a common gain is adjusted to adjust the number of bits until a number of bits smaller than the calculated number of bits is used for the Huffman-coding. For example, when a frame of an audio signal is sampled 1024 times at 44.1 KHz, a number of bits used for coding the 1024 frame samples at 128 kbps is calculated as in Equation 3, and a common gain is adjusted to be less than the calculated number of bits:

$$\frac{1{,}024}{44{,}100} \times 128{,}000 = 2{,}972 \tag{3}$$

In step S420, quantization noise energy is calculated in all frequency bands of an audio frequency. In other words, the magnitude of quantization noise energy in each frequency band is calculated using a difference between a received MDCT coefficient mdct_line and a quantized MDCT coefficient $x_{quant}$. In step S430, scale factors used for the calculation of the magnitude of the quantization noise energy are stored. In step S440, a determination is made whether the calculated magnitude of the quantization noise energy is greater than the quantization noise threshold calculated in the psychoacoustic model. If the quantization noise energy is greater than the quantization noise threshold, noise energy of the quantized MDCT coefficient $X_{quant}$ is reduced. The reduction in the noise energy of the quantized MDCT coefficient may be achieved by adjusting the scale factor band gain.

Figure 5A:
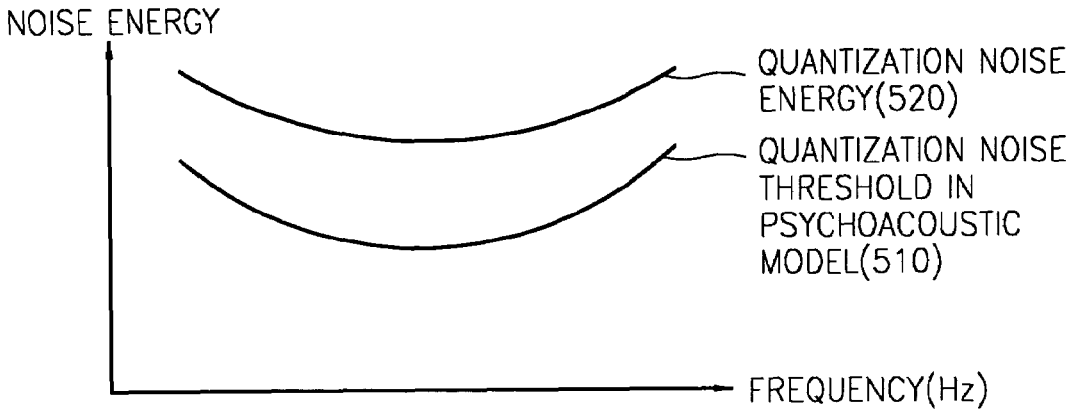
FIGS. 5A and 5B illustrates shaping of noise energy of a quantized MDCT coefficient by adjusting a scale factor band gain in each frequency band.
Figure 5B:
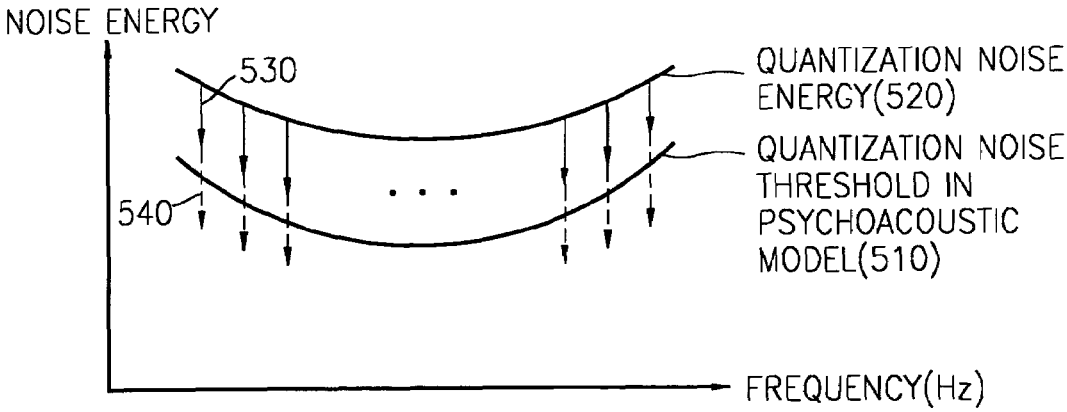

FIGS. 5A and 5B illustrate the adjustment of the noise energy of the quantized MDCT coefficient through the adjustment of the scale factor band gain in each frequency band.

Let us assume that the quantization noise energy of the quantized MDCT coefficient appears as reference numeral 520 of FIG. 5A. As can be seen in FIG. 5A, since the quantization noise energy of the quantized MDCT is greater than a quantization noise threshold 510 calculated in the psychoacoustic model, in step S450, the scale factor band gain is adjusted in each frequency band. In step S460, a determination is made whether the scale factor band gain in every frequency band has been increased. If the scale factor band gain in every frequency band has been increased, a determination is made that a desired sound quality requirement is not satisfied at a given bit rate, and the shaping of the quantization noise ends using the scale factors stored in step S430. If not, a next step is performed.

The adjustment of the scale factor band gain may result in the shaping of the quantization noise as indicated by arrows 530 or 540. However, the scale factor band gain is increased to a limit. Thus, in step S470, a determination is made whether the quantization noise is shaped to fall within the quantization noise threshold 510 only when the scale factor band gain is increased to be above a predetermined threshold value. If the determination is made that the quantization noise is shaped to fall within the quantization noise threshold 510 only when the scale factor band gain is increased to be above the predetermined threshold value, in step S490, a determination is made that a desired sound quality is not satisfied at the given bit rate and the shaping of the quantization noise ends using the stored scale factors. If not, a next step is performed.

In step S480, a determination is made whether quantization noise in at least one frequency band is above the quantization noise threshold. If the determination is made that the quantization noise in the at least one frequency band is above the quantization noise threshold, step S410 restarts to readjust the number of bits. In other words, the number of bits increases little by little so that the number of bits is below a threshold value.

Figure 6:
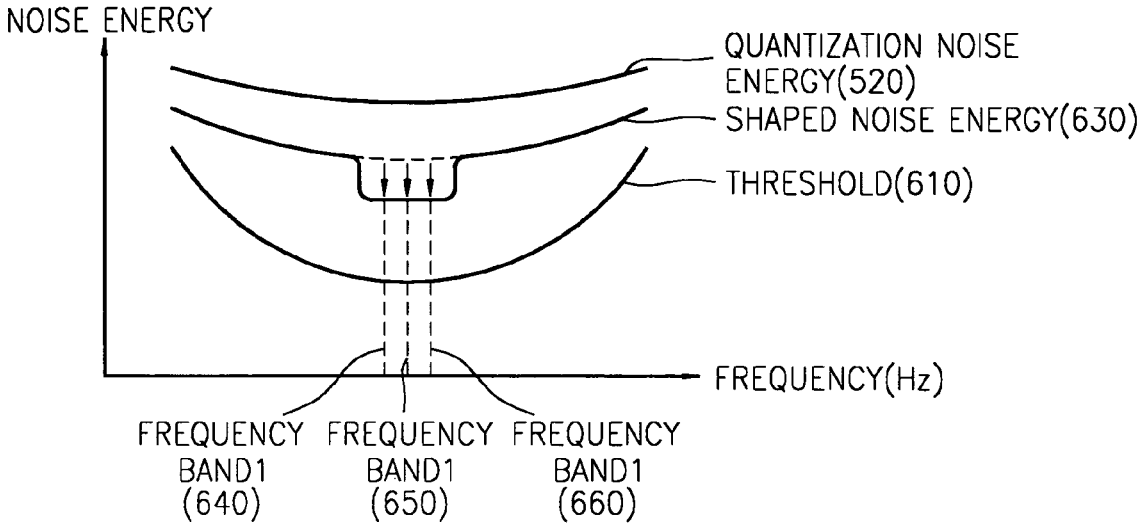
FIG. 6 illustrates a process of selectively increasing a scale factor band gain in each frequency bandwidth.

FIG. 6 illustrates a process of selectively increasing the scale factor band gain in each frequency band. As shown in FIG. 6, a threshold 610 is calculated in a psychoacoustic model. Noise energy 620 of a quantized MDCT coefficient is calculated. A quantization error is reduced in a predetermined number of frequency bands in which a difference between the threshold 610 and the noise energy 620 of the quantized MDCT coefficient is great. The difference is the greatest in a frequency band 1 640, a frequency band 2 650, and a frequency band 3 660. Thus, the quantization noise is first reduced in the frequency band 1 640, the frequency band 2 650, and the frequency band 3 660. In other words, instead of reducing quantization noise in every frequency band, a process of reducing noise energy of a quantized MDCT coefficient in a predetermined number of particular frequency bands is repeated so that the same amount of quantization error occurs in all the frequency bands.

In a method of shaping quantization noise in the compression of MPEG audio data, according to the present invention, an allowed bit rate is too low for quantization noise to be below a threshold noise level calculated in a psychoacoustic model. Nevertheless, a scale factor band gain adjuster can variably adjust a scale factor band gain according to the MPEG standards in order to shape the quantization noise in each frequency band to the threshold noise level in each frequency band in the psychoacoustic model.

The conventional method separately performs an external loop for each frequency to increase the scale factor band gain in each frequency band by comparing the quantization noise in each frequency band with the quantization noise threshold. However, in the present invention, instead of comparing quantization noise with quantization noise threshold in an external loop through which a scale factor band gain is adjusted, the external loop ends after first adjusting the scale factor band gain all the frequency bands in which quantization noise is the highest according to the ranking of noise-to-mask ratios (NMRs) in the frequency bands.

Figure 7:
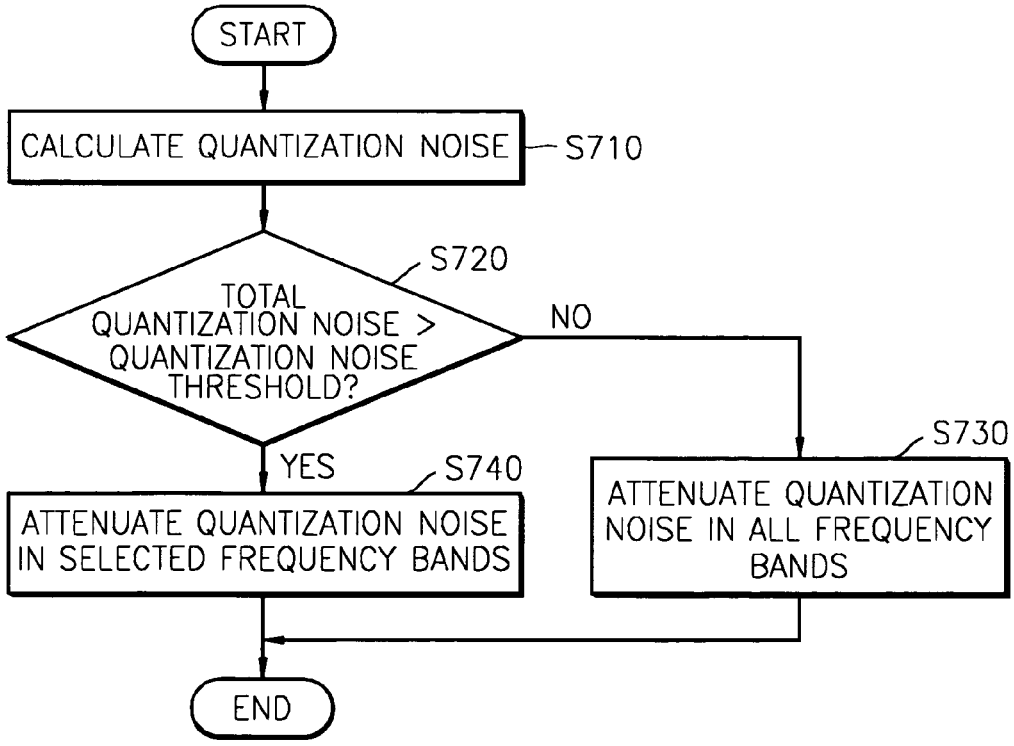
FIG. 7 is a flowchart of a method of reducing quantization noise according to the present invention.

FIG. 7 is a flowchart of a method of attenuating quantization noise according to the present invention.

In step S710, total quantization noise of a quantized MDCT coefficient and a total sum of quantization noise thresholds calculated in a psychoacoustic model are calculated. In step S720, the total quantization noise of the quantized MDCT coefficient is compared with the total sum of the quantization noise thresholds. If the total quantization noise of the quantized MDCT coefficient is less than the total sum of the quantization noise thresholds, in step S730, the quantization noise is attenuated according to an existing method. If the total quantization noise of the quantized MDCT coefficient is greater than the total sum of the quantization noise thresholds, in step S740, the quantization noise is selectively attenuated in each frequency band. In other words, an external loop ends after adjusting a scale factor band gain in frequency bands of all frequency bands in which quantization noise is higher than a quantization noise threshold according to the ranking of NMRs in all the frequency bands. A process of attenuating quantization noise in the entire frequency band is as described with reference to FIG. 4.

Figure 8:
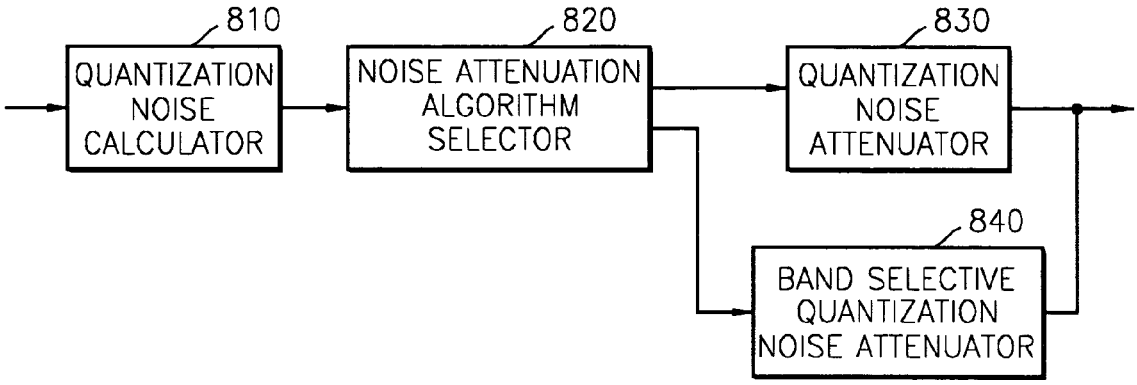
FIG. 8 is a block diagram of a quantization noise attenuator according to the present invention.

FIG. 8 is a block diagram of a quantization noise attenuating apparatus according to the present invention. Referring to FIG. 8, the quantization noise attenuating apparatus includes a quantization noise calculator 810, a noise attenuation algorithm selector 820, a quantization noise attenuator 830, and a band selective quantization noise attenuator 840.

The quantization noise calculator 810 calculates total quantization noise of a quantized MDCT coefficient and a sum of quantization noise thresholds calculated in a psychoacoustic model.

The noise attenuation algorithm selector 820 compares the total quantization noise value of the MDCT coefficient with the sum of the quantization noise thresholds to determine whether a quantization noise attenuation is performed in all frequency bands or in selected particular frequency bands.

The quantization noise attenuator 830 attenuates quantization noise in all the frequency bands. In other words, when a predetermined bit rate is determined to compress an audio signal, the quantization noise attenuator 830 calculates a number of bits corresponding to the predetermined bit rate, adjusts the number of bits by adjusting a common gain until a number of bits smaller than the calculated number of bits is used for the compression, and adjusts a degree to which quantization noise is attenuated in each frequency band by adjusting a scale factor band gain. Details of this are as described with reference to FIG. 4.

The band selective quantization noise attenuator 840 attenuates quantization noise in selected frequency bands. In other words, the band selective quantization noise attenuator 840 adjusts scale factors in a predetermined number of frequency bands according to the ranking of NMRs of the number of frequency bands in which the quantization noise of the quantized MDCT coefficient is greater than the quantization noise threshold in the psychoacoustic model.

As described above, according to the present invention, even if an allowed bit rate disables quantization noise to fall below a quantization noise threshold obtained from a psychoacoustic model, an envelope of the quantization noise can be shaped to be equal to a curve of the quantization noise threshold. Thus, quantization noise in each frequency band is equally above the quantization noise threshold. As a result, unlike the prior art, the present invention can prevent quantization noise threshold in particular frequency bands from excessively going beyond the quantization noise. This results in an improvement of sound quality.

In quantization for existing MPEG audio compression, a limited number of bits is ineffectively allocated, which directly affects deterioration of sound quality. However, in the present invention, with selective adoption of the prior art bit allocation method, if frequency bands in which quantization noise is to be attenuated are many at a low bit rate, quantization noise is attenuated in frequency bands corresponding to a predetermined bit rate instead of attenuating quantization noise in all frequency bands. Even though this quantization process does not allow quantization noise in all frequency bands to fall below the quantization noise threshold, the quantization noise can be shaped to be similar to the quantization noise threshold. As a result, sound quality can be improved.

The present invention can be realized as a computer-readable code on a computer-readable recording medium. Computer-readable recording media include recording apparatuses storing computer-readable data. Computer-readable recording media include ROMs, RAMs, CD-ROMs, magnetic tapes, floppy discs, and optical data storage devices. The computer-readable recording media can also store and execute a computer-readable code in computers connected via a network in a dispersion way.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A method of shaping quantization noise, comprising:

calculating a total quantization noise of quantized MDCT coefficients and a sum of quantization noise thresholds calculated in a psychoacoustic model;

comparing the total quantization noise of the quantized MDCT coefficients with the sum of the quantization noise thresholds; and if the total quantization noise of the quantized MDCT coefficients is less than the sum of the quantization noise thresholds, attenuating quantization noise of a plurality of frequency bands, while if the total quantization noise of the quantized MDCT coefficients is greater than the sum of the quantization noise thresholds, attenuating the quantization noise in selected frequency bands of the plurality of frequency bands, wherein the attenuation of the quantization noise in the selected frequency bands comprises:

receiving an audio frame, quantizing MDCT coefficients to produce a quantization result, Huffman-coding the quantization result, calculating a number of bits used for the Huffman-coding, and setting the number of bits to use a number of bits smaller than the calculated number of bits in order to control a bit rate;

calculating quantization noise energy of the plurality of frequency bands of an audio frequency range to output calculated quantization noise energy;

storing scale factors used in the quantizing MDCT coefficients;

determining whether the calculated quantization energy is above a quantization noise threshold calculated in the psychoacoustic model, and if the calculated quantization energy is above the quantization noise threshold, shaping the quantized noise energy of the quantized MDCT coefficients to be reduced;

determining whether a scale factor band gain has increased in the plurality of frequency bands, and if the scale factor band gain has increased in the plurality of frequency bands, ending the shaping quantization noise energy using the stored scale factor;

if the scale factor band gain has increased in less than the plurality of the frequency bands, then if the quantization noise energy is shaped to fall within the quantization noise threshold in the psychoacoustic model only when the scale factor band gain increases to be above a predetermined quantization noise threshold, ending the shaping of the quantization noise using the stored scale factor, and if the scale factor band gain does not increase to be above the predetermined quantization noise threshold, then readjusting the bit rate.

2. The method of claim 1, wherein the bit rate is controlled by adjusting a common gain.

3. The method of claim 1, wherein the quantization energy of the quantized MDCT coefficient is controlled by adjusting the scale factor band gain.

* * * * *